United States Patent [19]

Bieler

[11] 4,018,455

[45] Apr. 19, 1977

[54] BRAKING DEVICE FOR SKIS

[76] Inventor: Hans Bieler, Haus Sableun, Bonaduz, Switzerland

[22] Filed: Apr. 11, 1975

[21] Appl. No.: 567,102

[30] Foreign Application Priority Data

| | | |
|---|---|---|
| Apr. 19, 1974 | Switzerland | 5431/74 |
| July 8, 1974 | Switzerland | 9358/74 |

[52] U.S. Cl. ..... 280/605; 188/6; 188/8

[51] Int. Cl.[2] ..... A63C 7/10

[58] Field of Search .... 188/6, 8; 280/605, 11.13 B, 280/11.13 C

[56] References Cited

UNITED STATES PATENTS

| | | | |
|---|---|---|---|
| 3,048,418 | 8/1962 | Gertsch | 280/11.13 B |
| 3,433,494 | 3/1969 | Hinterholzer | 280/11.13 B |
| 3,704,024 | 11/1972 | Martin | 280/11.13 B |
| 3,724,867 | 4/1973 | Hawthorne | 280/605 |
| 3,917,297 | 11/1975 | Fruh | 280/605 |

FOREIGN PATENTS OR APPLICATIONS

| | | | |
|---|---|---|---|
| 140,265 | 1/1935 | Austria | 280/605 |
| 216,398 | 7/1961 | Austria | 280/11.13 B |
| 112,640 | 12/1944 | Sweden | 280/11.13 B |
| 75,461 | 1/1918 | Switzerland | 280/11.13 B |

*Primary Examiner*—George E. A. Halvosa
*Attorney, Agent, or Firm*—Larson, Taylor and Hinds

[57] ABSTRACT

Ski braking devices are described for braking skis when they become accidentally detached from skiers' boots so as to bring the skis to rest in safe positions without hurting the skiers or other persons. Each described device has a frame with spaced parallel plates extending across the ski and a braking lever pivoted between them about an axis at one edge of the ski. A pivoted holding device snaps over the lever to hold it in an inoperative position in which it lies over the ski. When putting on the ski, the skier releases the holding device, for example with his boot, but the braking lever is retained in the inoperative position by the boot. On being released, the holding device is swung away from the braking lever by spring action. When the ski becomes detached, a spring swings the braking lever through about 270° so that it projects downwards into the snow. On reaching this braking position, the spring shifts the braking lever along its axis to bring locking members into engagement and thereby fix the braking lever with respect to the frame. The braking lever is a flat plate and may be formed with a recess in which is pivoted a braking flap that lies in the plane of the braking lever when in the inoperative position but when the lever swings to its operative position, is caused by its inertia to swing out to a position perpendicular to the braking lever, in which the flap is automatically locked to the lever so that the flap presents its face to the direction of ski movement.

20 Claims, 6 Drawing Figures

BRAKING DEVICE FOR SKIS

FIELD OF THE INVENTION

The present invention relates to braking devices for skis, particularly for braking loose moving skis.

DESCRIPTION OF THE PRIOR ART

It is known that, when a skier falls, the bindings of one of both skis are released from the feet of the skier, and the skis may hurt either the skier or other persons. In a known device for preventing injuries, a retaining belt is used which is fixed around the ankle of the skier. This may prevent the ski from flying away and from hurting other persons, but many cases are known where skiers themselves were hurt.

In another device for protecting skiers, there is provided, between the ski bindings on the ski, a casing with a spring mechanism. Furthermore, two mutually connected, torsion spring-biased levers are provided which are displaced by approximately 180°. When putting on the skis, the first lever is pressed from its approximately vertical upward position over the shoe into an approximately horizontal position, directed backwards. At the same time, the second lever which is the proper braking lever is swivelled from its vertical downward position into its horizontal position directed forwards on the side of the ski. If the skier falls and the ski is released, the first lever is released suddenly and, because of its spring bias, is swivelled upwards. At the same time, the second lever is swivelled downwards into its braking position. The disadvantage of this device is that the flexibility of the braking lever made of wire, together with the flexibility of the torsion spring, act in series so that the obtainable braking effect is unsatisfactory. The braking lever is unstable and reacts to unevenness of the snow surface by resilient oscillatory movements and jumps over the snow surface instead of digging into the snow. Furthermore, when putting on the skis, special measures are necessary to release the lever so that it can become active in an emergency. Finally, the height of the device is too great so that it is not possible to use it on every type of ski.

SUMMARY OF THE INVENTION

It is the purpose of the present invention to avoid the disadvantages of the known device and to provide a device of the type mentioned above which can be mounted under every type of ski boot at any place between ski bindings and which comprises a rigid braking lever and a stable, safely operating construction which does not necessitate special measures for assuring its operation in case of an emergency, which furthermore assures effective braking of the ski and prevents injuries to the skier and to other persons.

This problem is resolved by means of the braking device of the type described above by providing a rigid braking lever which can swing about an axis on a frame to be mounted on the ski which, in a first angular position, is in engagement with a holding device, which keeps the braking lever in a first angular position with respect to the frame, so that, by releasing said engagement, the braking lever can be swung automatically into a second angular position in which it forms a second angle with the frame, means being provided which fix the braking lever in its second angular position in rigid relationship with respect to the frame.

In order to increase the braking effect, the ski braking device of the present invention may comprise a braking flap rotatably fixed on the braking lever which, in the second angular position of the braking lever, assumes a braking position which is approximately perpendicular with respect to the plane of the braking lever and with respect to the direction of movement of the ski.

In a preferred embodiment of the invention, the holding device may consist of a holding loop that can be turned about a second axis on the frame which, in a first position, i.e. when swivelled over the braking lever, holds the braking lever in its first angular position, and in its second position, when swivelled away from the braking lever, releases the braking lever, the holding loop being turned from its first position into its second position or from the latter back into its first position by exerting a turning moment on the loop.

The advantage of this arrangement is that the holding loop does not move away from the braking lever under its own weight, but releases the braking lever or alternatively prepares the braking device for exercising its function only if a pronounced turning moment, for example, applied by the skier's boot to the ski, is exerted on the holding loop. Furthermore, it is assured that the releasing of the braking lever can be effected by all types of boots, including boots having very narrow soles.

DESCRIPTION OF THE DRAWINGS

In order that the invention may be clearly understood and readily carried into effect two ski braking devices in accordance therewith will now be described, by way of example, with reference to the accompanying drawings, in which.

Figure 1:
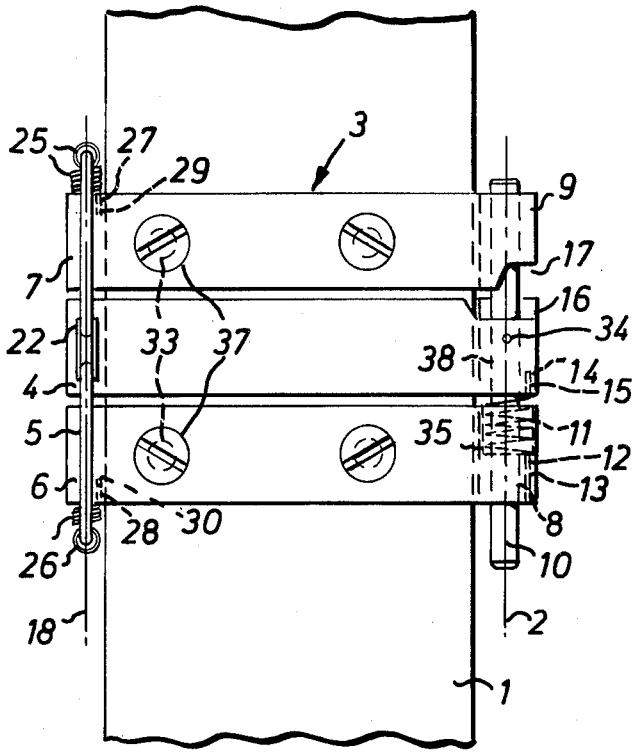
FIG. 1 shows a plan view of a ski braking device shown in an inoperative position, mounted on a ski.

In the drawings, the same parts have the same reference numerals. On a ski 1, there is fixed a frame 3 by means of screws 37. The frame 3 has two limbs 6, 7 extending transversely across the ski 1, which are spaced from each other in parallel relationship, on the upper face of ski 1. Each limb 6, 7 has, at one of its ends, a transverse bore 8, 9. These bores have a common axis 2 which extends in the fore and aft direction of the ski. A pivot pin 10 passes through the bores 8, 9 and is rotatable about axis 2 and is arranged to slide in the longitudinal direction of axis 2.

Between the two limbs 6, 7, there is provided a braking lever 4 having a bore 38 through which the pivot pin 10 passes. The braking lever is fixed on the pivot pin 10 by means of pin 34. The bore 8 of the limb 6 has a portion 35 of increased diameter which is shaped so as to receive a helical spring 11. One end 12 of the helical spring 11 is fixed into a bore 13 in the limb 6, of small diameter, whereas the other end 14 of the helical spring 11, is fixed into a similar bore 15 in braking lever 4. The helical spring 11 is so mounted in the portion 35 of bore 8 and in bores 13 and 15 in a stressed condition that, when mounted, it exerts on the braking lever a torsional moment as well as an axial force. The torsional moment acts on the braking lever 4 so that it is automatically swung into its second angular position. In this second position, the braking lever 4 forms, with the plane of frame 3, an angle $\beta$ which is approximately 270°. As soon as this position is reached, the axial pressure exerted by helical spring 11 on braking lever 4 causes the braking lever to be shifted axially in the direction of the limb 7 into its locked position. This is rendered possible by the braking lever 4 having at its end, enclosing the pivot pin 10, a projection 16 which, in the second angular position of the braking lever, is situated opposite a complementary recess 17 of the second limb 7. The axial pressure which the spring 11 exerts on the braking lever 4 urges the projection and recess 16, 17 into mutual engagement whereby the braking lever takes up a permanent angular position and remains rigidly located with respect to frame 3.

Each of the limbs 6 and 7 contains a bore 19, 20.

Figure 2:
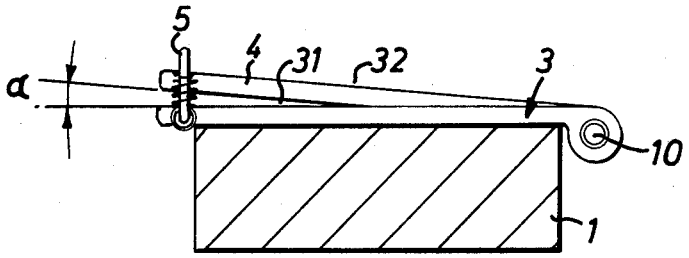
FIG. 2 shows a front elevation of the braking device of FIG. 1.
Figure 3:
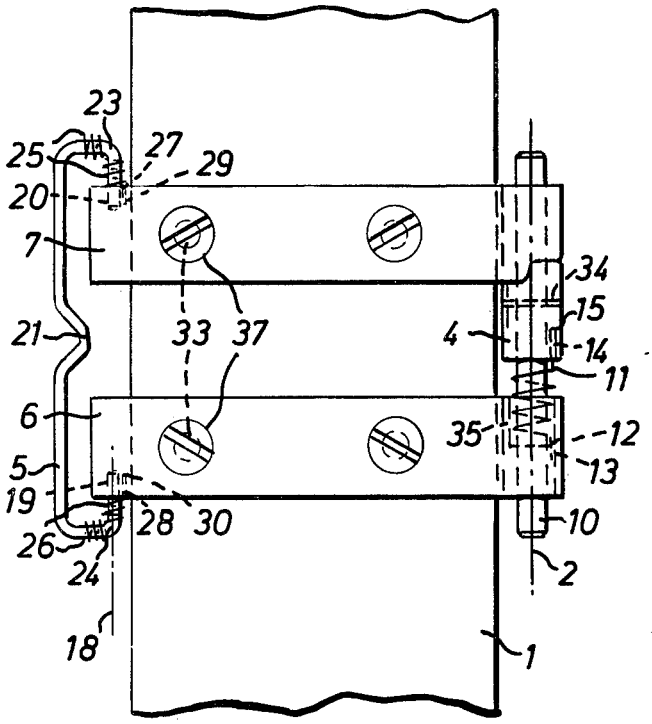
FIG. 3 shows a plan view of the braking device of FIGS. 1 and 2 when in its operative condition.

The bores 19, 20 have a common second axis 18 parallel to axis 2. A holding loop 5 consists of wire and has the shape of the letter U with bent ends 23, 24. These ends are pivotally mounted on the second axis 18 of frame 3 in the bores 19, 20. The holding loop 5 has a projection 21 which, in a first angular position of the braking lever, is put into mutual engagement with a snap-in groove 22 provided in the area of the outer end of the braking lever 4 and holds it in the first mentioned angular position. In this position, the braking lever 4 forms, with the plane of frame 3, an acute angle $\alpha$ which may for example be 10° (FIG. 2).

Each bent end 23, 24 of the U-shaped holding loop 5 has a helical spring 25, 26 closely encircling the end concerned. One of the ends 27, 28 of each helical spring 25, 26 which is bent part of the way along its axis, extends into a bore 29, 30 of the associated limb 6, 7 which is located near the bore 19, 20 and has a smaller diameter than the latter. The helical springs 25, 26 exert a torsional moment on the holding loop 5 which, after release of the engagement between braking lever 4 and holding loop 5 induces the latter automatically to turn from its engaged position into its disengaged position.

The operation of the ski braking device will now be described.

If the ski 1 is out of use, the braking lever 4 is in its first angular position which may also be designated as inactive position, and is kept in this position by holding loop 5, the projection 21 of which is in engagement with snap-in groove 22 of braking lever 4. The lever 4 has a low profile permitting it to be located beneath the skiers boot. If the skier puts on his skis, he treads on the inclined braking lever 4 and makes it swivel downwards by the pressure of his boot. Thereupon, the nose 21 is disengaged from snap-in groove 22, and the holding loop is swivelled outwardly by the effect of the torsion springs 25, 26 from its engaged position into its disengaged position. Thereby, the braking lever is released but is then kept in approximately the horizontal position by the pressure of the boot to which the ski is attached.

Figure 4:
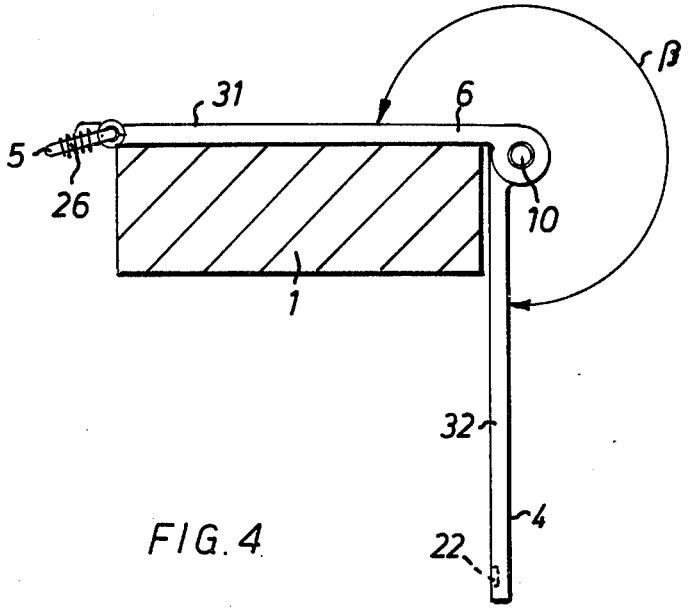
FIG. 4 shows a front elevation of the braking device of FIG. 3.

If the skier falls and loses his ski, the braking lever is suddenly released entirely and, because of the torsional moment exerted on it by the helical spring 11, is swung into its second angular position in which it forms, with the plane of the frame 3, the angle $\beta$ of for example 270° (FIG. 4). The pressure exerted by the helical spring 11 on braking lever 4 in the axial direction of the pivot pin 10 then displaces pivot pin 10 and braking lever 4 in the direction of the limb 7 to cause mutual engagement of the projections 16, 17 with one another and therefore locking of the braking lever 4 in its engaged second angular position in which it remains rigid with respect to frame 3. The braking lever 4 then digs into the snow or throws the ski over so that it comes to rest on the binding face. Each ski is braked so that it will stop a few meters away from the skier without hurting either him or other persons.

To put on the ski again, the braking lever 4 is shifted along the axis 2 from its engaged position in the direction of limb 6 by manual pressure, swung into its first angular position (FIG. 2) and is then brought into engagement with the holding loop 5.

Figure 5:
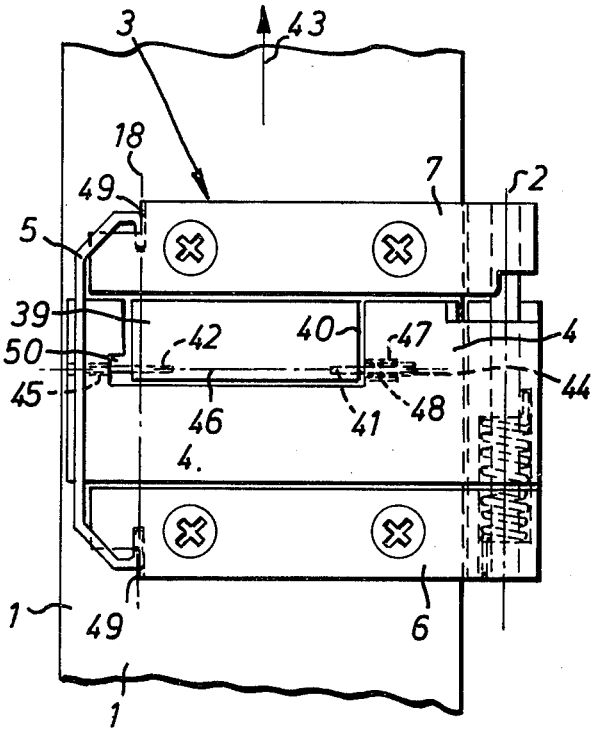
FIG. 5 shows a plan view of a modified ski braking device shown in an inoperative condition mounted on a ski.
Figure 6:
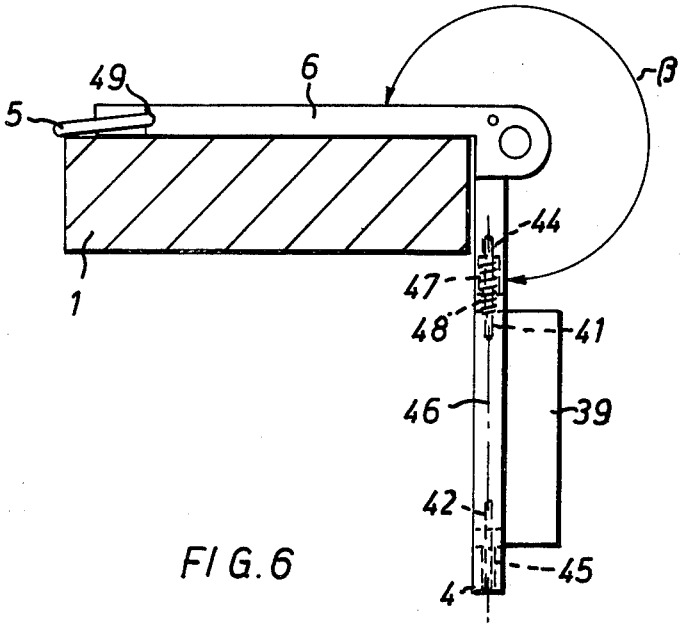
FIG. 6 shows a front elevation of the braking device of FIG. 5, when in its operative condition.

The form of braking device shown in FIGS. 5 and 6 comprises a braking lever 4 which is formed with a recess 40 for receiving a braking flap 39. The braking flap 39 essentially consists of a rectangular plate the thickness of which approximately corresponds to the thickness of the braking lever 4. Pins 41, 42 project from two parallel transverse edges of the braking flap 39 in opposite directions and are pressed into holes of the braking flap 39. The pins 41, 42 are arranged along a common axis which extends near to and in parallel with a longitudinal edge of the braking flap 39.

The braking lever 4 has two bores 44, 45 in which the braking flap 39 is pivotally supported about axis 46 by means of pins 41, 42. The bores 44, 45 are of equal diameter and this diameter is greater than the diameter of pins 41, 42 so that the braking flap can be turned easily about its axis 46.

The bore 44 of the braking lever 4 has, at the end which faces the braking flap 39, a bore 47 of a larger diameter in which a helical spring 48 is countersunk. One end of this spring exerts a pressure on the adjacent transverse edge of the braking flap 39. A recess 50 provided in the braking lever 4 enables the braking flap 39 to be locked in the braking position thereof shown in FIG. 6.

The braking flap 39 is so arranged with respect to the braking lever 4 that when in operation, it projects laterally outwards with respect to the direction 43 of movement of the ski (FIG. 6). Accordingly, left-handed and right-handed braking levers or braking devices are provided respectively for use on the left-hand and right-hand skis.

In a preferred further development of the holding device, the latter consists of a holding lever with two limit positions. In its first limit position, the holding loop 5 is swivelled over the free end of braking lever 4 which it holds in its first angular position. In this case, its movement is limited by two abutment surfaces 49 provided on the two limbs 6, 7 of the frame. In this first limit position, the holding loop 5 forms, with the plane of frame 3 an angle of approximately 45°. In its second limit position, the holding loop 5 is swung away from the braking lever 4, its movement being limited by the upper surface of ski 1. The turning of the holding loop 5 from its first into its second limit position or vice versa calls for exerting a pronounced torsional moment on the holding loop, as may for example be done by hand or when putting on the ski 1, by means of the skier's boot. In this case, the release of the braking lever when putting on the ski is effected positively by the skier's boot and the readiness for function of the braking device restored, in this example by any type of boot, even those with very narrow soles.

The operation of the braking flap 39 will now be described.

If the ski 1 is not in use and the braking lever 4 is in the first angular position, or alternatively if the skier puts on the ski, the braking flap 39 is in a position which is slightly distorted downwards with respect to the braking lever 4, whereby it is kept in contact with the surface of ski 1. If the skier falls and loses his ski, the braking lever is disengaged suddenly and swung into its second angular position. The braking lever 4 takes with it the braking flap 39 which however, because of its inertia, and of the play provided between the bores 44, 45 the pins 41, 42 as well as an abutment effect provided by the braking lever 4 itself, takes its braking position in the second angular position of the braking lever and is held by the braking lever in that position. The position is approximately perpendicular with respect to the plane of the braking lever and to the direction 43 of ski movement. The braking flap 39 brakes the moving ski 1 with its whole front surface which has dug into the snow and exerts a strong braking effect in addition to the braking effect of braking lever 4. Careful experiments have shown that the ski braking device provided with the braking flap 39 indeed assures rapid and improved braking of the ski in all types of snow.

The following are the advantages of the ski braking device according to the present invention and its various embodiments.

a. the device has a rigid braking lever which becomes fixed in its braking position, is rigid with respect to the ski and effectively brakes the ski;

b. when putting on the ski, the device is automatically made ready to operate in an emergency without the necessity of any special measures;

c. the device can be mounted at any place between any ski boot attachment devices since its height is only 4 millimetres;

d. a ski braking device coated with a low friction coating may serve as one of the two necessary base plates on a ski whereby it is possible to do without one such plate; the low friction coating may be of Teflon.

e. the device is simple, safe and cheap and complies with the severest safety requirements.

I claim:

1. A ski braking device for braking a ski when it becomes accidentally detached from a skier's boot, the device comprising a frame adapted to be fixed to the top surface of a ski, a rigid braking lever mounted to pivot about an axis on said frame which extends fore and aft of the ski from a first angular position, in which said braking lever extends from the end thereof at the said pivot transversely across the top surface of the ski to an outer end located essentially on the opposite side of the ski, to a second angular position in which said braking lever pivots more than 180° about said axis to extend downwards beneath the ski, said lever having a low profile positionable beneath the skier's boot in said first position, a holding device located at the outer end of the lever when said lever is in said first position and movably mounted on said frame between a first location at which said holding device engages said outer end of the braking lever to hold the braking lever in said first angular position and a second location at which said holding device is moved out of the path of the lever to release said outer end and hence release said braking device for movement to the second angular position upon separation of the skier's boot therefrom, resilient means operative on said braking lever to turn said braking lever automatically from said first angular position to said second angular position when released by said holding device and upon separation of the skier's boot from the lever, and fixing means for automatically fixing said braking lever, immediately on reaching said second angular position, against resilient turning movement back towards said first angular position.

2. A ski braking device according to claim 1, wherein said frame comprises two spaced limbs for extending across and adapted to be fixed to the ski with adjacent ends thereof close to one edge of said ski, said braking lever being mounted between said limbs with one end adjacent said ends of said limbs, and a pivotal mounting for said braking lever interconnecting said end of said lever with said ends of said limbs.

3. A ski braking device according to claim 2, wherein said two spaced limbs are formed with co-axial bores having open ends facing one another, and said pivotal mounting comprises pin projections extending from said braking lever into said bores, and wherein said resilient means is a helical spring countersunk in one of said bores and fixed at one end to said braking lever and at the other end to the one of said limbs containing said one of said bores.

4. A ski braking device according to claim 2, in which said holding device comprises a wire loop formed at its ends with projections extending into further bores formed in said frame limbs so that said loop is pivotally mounted on said frame, said loop being formed between its end with a projection in snap-in engagement with said braking lever when said holding device is in said first location, and two helical springs containing respectively end portions of said wire loop and fixed respectively at ends thereof to said limbs for automatically turning said loop to said second location when released from said snap-in engagement.

5. A ski braking device according to claim 2, wherein said two limbs are flat plates and said braking lever is a flat plate, and wherein said first angular position said braking lever makes an angle of less than 15° with respect to said frame and in said second angular position an angle of approximately 270°.

6. A ski braking device according to claim 2, wherein said two limbs are flat plates and said braking lever is a flat plate, the total height of the device with respect to the top surface of a ski being approximately 4 millimeters when said braking lever is in said first angular position.

7. A ski braking device according to claim 1, wherein said frame comprises two spaced limbs adapted to extend across and be fixed to said ski with adjacent ends of said limbs close to one edge of said ski and formed respectively with co-axial bores having open ends facing one another, said braking lever being mounted between said limbs with one end adjacent said ends of said limbs, pivot pin projections on said braking lever projecting into said bores, a helical spring, constituting said resilient means, one of said limbs having the bore therein formed with a countersunk enlargement, said helical spring being mounted in said countersunk enlargement and fixed at one end thereof to said braking lever and at the other end thereof to said one of said limbs, said automatic fixing means comprising a projection on the side of said braking lever remote from said spring and a co-operating recess in the other of said limbs located to receive and hold said projection when said braking lever is in said second angular position, and said helical spring being stressed, when said braking lever is in said first angular position, to turn said lever into said second angular position and urge said braking lever laterally to engage said fixing means.

8. A ski braking device according to claim 1, wherein said holding device is mounted to pivot on said frame about a second axis parallel to said first axis and wherein said holding device and said brake lever are formed for said holding device to latch onto said braking lever when said holding device is in said first location, to be released from that location by the application of pressure, and resilient means for turning said holding device to said second location when released from said first location.

9. A ski braking device according to claim 1, wherein said braking lever is a flat plate pivotally mounted to lie with one face approximately parallel to the top surface of a ski when said braking lever is in said first angular position, the braking device comprising also a braking flap pivotally mounted on said braking lever about an axis close to one edge of said flap and approximately perpendicular to said first-mentioned axis to lie approximately parallel to the top surface of the ski when said braking lever is in said first angular position, whereby said flap swings into a plane approximately perpendicular to said braking lever when the latter moves to said second angular position and means for retaining said braking flap in said position approximately perpendicular to said braking lever.

10. A ski braking device according to claim 9, wherein said braking lever is formed with a recess in one edge thereof, said braking flap being located in said recess, and the device comprising pin and bore pivotal connections on said second axis between opposite edges of said braking flap and adjacent edges of said recess, said recess and pin and bore pivotal connections providing sufficient play between said braking flap and said braking lever to enable said braking flap to move freely about said second axis, to said position approximately perpendicular to said braking lever.

11. A ski braking device according to claim 9, wherein said braking lever is formed with a recess in one edge thereof, said braking flap being located in said recess, and the device comprising pin and more pivotal connections on said second axis between opposite edges of said braking flap and adjacent opposed edges of said recess, a helical spring countersunk in the bore in one of said pin and bore connections, a further recess formed in the edge of said first mentioned recess opposite said spring, said spring being operative to thrust said braking flap partly into said second recess on turning into said plane approximately perpendicular to said braking lever.

12. A ski braking device according to claim 1, wherein a low friction coating is applied to surfaces of said frame and said brake lever that come into contact with the skier's boot when the device is mounted on a ski.

13. A ski braking device according to claim 1, said fixing means comprising a mutually engageable projection and recess, one of said projection or recess located on the frame and the other located on the braking lever, said projection and recess being aligned for engagement with each other only after the braking lever has moved to said second angular position, and resilient means for urging the projection and recess into engagement with each other after the lever has moved to said second angular position to prevent turning movement of the braking lever back from the second angular position toward said first angular position.

14. A ski braking device according to claim 1, said holding means comprising an elongated element extending across the top of said outer end of the brake lever, said elongated element being mounted to pivot about a second axis substantially parallel to the first said axis from a holding position to a second position outwardly away from the outer end of the braking lever at which it releases said outer end of the braking lever.

15. A ski braking device according to claim 1, said frame comprising a pair of limbs extending transversely across the ski from a first side to a second side thereof, said pivot axis located on a first side of the ski, and including a pivot pin extending between said limbs at said first side of the ski, and said braking lever mounted on said pivot pin, and said holding means comprising a holding element pivotally mounted in the other side of the limbs on the second side of the ski, the pivot axis of said holding element being substantially parallel to the said braking lever axis, said holding element being moveable about its axis from a first position at which it holds the outer end of the braking lever to a second position at which it releases the outer end of the braking lever.

16. A ski braking device for braking a ski when it becomes accidentally detached from a skier's boot, comprising a frame adapted to be fixed to the top surface of a ski, a rigid braking lever mounted to pivot about an axis on said frame from a first angular position in which the braking lever extends transversely across the top of the ski, to a second angular position in which the braking lever extends downwards beneath the ski, resilient means operative on said braking lever to turn said braking lever automatically from said first angular position to said second angular position, and fixing means operable when the braking lever reaches the second angular position for automatically preventing resilient turning movement of the braking lever from said second angular position back towards said first angular position, said fixing means comprising a mutually engagable projection and recess, one of said projection or recess located on the frame and the other located on the braking lever, said projection and recess being aligned in a direction parallel to said pivot axis to engage with each other upon movement, in said direction, of said projection or recess only after the braking lever has moved to said second angular position, and resilient means for urging the movable one of said projection or recess to move the projection and recess into engagement with each other after the lever has been moved to said second angular position to prevent turning movement of the braking lever back from the second angular position toward said first angular position.

17. A ski braking device according to claim 16, wherein said projection and recess are mounted about the pivot axis of the braking lever, and wherein the resilient means for urging the projection and recess into engagement with each other comprises a spring means also mounted on the pivot axis and operable to move the braking lever along said pivot axis to cause engagement of said projection and recess.

18. A ski braking device for braking a ski when it becomes accidentally detached from a skier's boot, the device comprising a frame adapted to be fixed to the top surface of a ski, a rigid braking lever mounted to pivot about an axis on said frame from a first angular position, in which said braking lever extends transversely across the top surface of the ski, to a second angular position in which said braking lever extends downwards beneath the ski, a holding device movably mounted on said frame and movable between a first location in which said holding device holds said braking lever in said first angular position and a second location in which said holding device releases said braking device, resilient means operative on said braking lever to turn said braking lever automatically from said first angular position to said second angular position when released by said holding device, and means for automatically fixing said braking lever, immediately on reaching said second angular position, in rigid engagement with respect to said frame, and wherein said braking lever is a flat plate pivotally mounted to lie with one face approximately parallel to the top surface of a ski when said braking lever is in said first angular position, the braking device comprising also a braking flap pivotally mounted on said braking lever about a further axis close to one edge of said flap and approximately perpendicular to said first-mentioned axis to lie in a first position approximately parallel to the top surface of the ski when said braking lever is in said first angular position, permitting said flap to swing to a second position into a plane approximately perpendicular to said braking lever when the latter moves to said second angular position, and a retaining means for retaining said braking flap in said second position approximately perpendicular to said braking lever, said retaining means comprising means for urging the braking flap along said further axis in the second position until portions of the braking flap and braking lever engage to hold the braking flap in said second position.

19. A ski braking device according to claim 18, wherein said braking lever is formed with a recess in one edge thereof, said braking flap being located in said recess, and the device comprising pin and bore pivotal connections on said second axis between opposite edges of said braking flap and adjacent edges of said recess, said recess and pin and bore pivotal connections providing sufficient play between said braking flap and said braking lever to enable said braking flap to move freely about said second axis, to said position approximately perpendicular to said braking lever.

20. A ski braking device according to claim 18, wherein said braking lever is formed with a recess in one edge thereof, said braking flap being located in said recess, and the device comprising pin and bore pivotal connections on said second axis between opposite edges of said braking flap and adjacent opposed edges of said recess, a helical spring countersunk in the bore in one of said pin and bore connections, and said retaining means comprising a further recess formed in the edge of said first-mentioned recess opposite said spring, said spring being operative to thrust said braking flap partly into said second recess on tirning into said plane approximately perpendicular to said braking lever.

* * * * *